US009562654B2

(12) United States Patent
Shimizu

(10) Patent No.: US 9,562,654 B2
(45) Date of Patent: Feb. 7, 2017

(54) LED ILLUMINATION APPARATUS INCLUDING LIGHT SOURCE AND LENSES

(71) Applicant: ROHM CO., LTD., Kyoto (JP)

(72) Inventor: Hirotaka Shimizu, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 14/809,944

(22) Filed: Jul. 27, 2015

(65) Prior Publication Data

US 2015/0330582 A1 Nov. 19, 2015

Related U.S. Application Data

(63) Continuation of application No. 13/804,102, filed on Mar. 14, 2013, now Pat. No. 9,121,554.

(30) Foreign Application Priority Data

Mar. 16, 2012 (JP) ..... 2012-060386
Mar. 16, 2012 (JP) ..... 2012-060387

(51) Int. Cl.

| | |
|---|---|
| ***F21V 5/00*** | (2015.01) |
| ***F21K 99/00*** | (2016.01) |
| ***F21V 5/04*** | (2006.01) |
| ***F21V 29/77*** | (2015.01) |
| *F21V 3/04* | (2006.01) |
| *F21V 21/30* | (2006.01) |
| *F21W 131/40* | (2006.01) |
| *F21V 29/507* | (2015.01) |
| *F21V 29/89* | (2015.01) |
| *F21Y 101/00* | (2016.01) |

(52) U.S. Cl.
CPC ..... *F21K 9/50* (2013.01); *F21V 5/007* (2013.01); *F21V 5/045* (2013.01); *F21V 29/773* (2015.01); *F21V 3/0436* (2013.01); *F21V 21/30* (2013.01); *F21V 29/507* (2015.01); *F21V 29/89* (2015.01); *F21W 2131/40* (2013.01); *F21Y 2101/00* (2013.01); *F21Y 2105/10* (2016.08); *F21Y 2115/10* (2016.08)

(58) Field of Classification Search
CPC ..... G02B 3/0056; G02B 19/0066; G02B 27/0961; G02B 3/0062; F21S 2/005; F21V 5/007; F21V 5/04; G09F 9/33
See application file for complete search history.

(56) References Cited

U.S. PATENT DOCUMENTS

| | | | | |
|---|---|---|---|---|
| 5,660,461 | A * | 8/1997 | Ignatius | F21V 29/004 257/668 |
| 7,068,432 | B2 | 6/2006 | Boettiger et al. | |
| 7,375,892 | B2 | 5/2008 | Boettiger et al. | |
| 7,476,562 | B2 | 1/2009 | Boettiger et al. | |
| 8,070,317 | B2 | 12/2011 | Zhang et al. | |

(Continued)

FOREIGN PATENT DOCUMENTS

| | | |
|---|---|---|
| JP | 2011-154844 | 8/2011 |

*Primary Examiner* — Tracie Y Green
(74) *Attorney, Agent, or Firm* — Hamre, Schumann, Mueller & Larson, P.C.

(57) ABSTRACT

An LED lamp includes: a plurality of light source units, each of which includes one or more LED chips and an emission surface through which light from the LED chips is emitted; and a lens unit having a plurality of lenses, each of which is located in front of the emission surface of each of the plurality of light source units.

13 Claims, 25 Drawing Sheets

(56) References Cited

U.S. PATENT DOCUMENTS

| | | | | |
|---|---|---|---|---|
| 8,795,559 | B2 | 8/2014 | Li et al. | |
| 2003/0043593 | A1 | 3/2003 | Amano | |
| 2006/0082887 | A1 | 4/2006 | Po-Hung et al. | |
| 2008/0192357 | A1 | 8/2008 | Boettiger et al. | |
| 2011/0063836 | A1 | 3/2011 | Salm | |
| 2011/0309384 | A1* | 12/2011 | Ito | H01L 33/505 257/88 |
| 2012/0075870 | A1* | 3/2012 | Kayanuma | F21V 5/04 362/311.06 |
| 2012/0087122 | A1* | 4/2012 | Takeuchi | G02F 1/133603 362/235 |

* cited by examiner

LED ILLUMINATION APPARATUS INCLUDING LIGHT SOURCE AND LENSES

CROSS-REFERENCE TO RELATED APPLICATIONS

This application is a Continuation of application Ser. No. 13/804,102, filed Mar. 14, 2013, which is based upon and claims the benefit of priority from Japanese Patent Application Nos. 2012-60386, filed on Mar. 16, 2012, and 2012-60387, filed on Mar. 16, 2012, the entire contents of which are incorporated herein by reference.

TECHNICAL FIELD

The present disclosure relates to an LED lamp used as a substitute for, for example, a mercury lamp, and an LED lamp lens unit included in the LED lamp.

BACKGROUND

FIG. 25 illustrates a conventional LED lamp 900. The LED lamp 900 as shown in FIG. 25 includes a substrate 901 and a plurality of LED modules 902 mounted thereon. The LED lamp 900 may be used as a substitute for, for example, a mercury lamp. Each LED module 902 includes an LED chip 903 and a case 904. The LED chip 903 is mounted on the case 904. A mount electrode (not shown) is installed in the case 904. The LED module 902 configured as above is subjected to a heating treatment at a predetermined temperature within a reflow furnace, for example, under a condition where the mount electrode is temporarily bonded to a wiring pattern (not shown) of the substrate 901 by means of solder paste, which is called "surface mounting."

Mercury lamps are installed on a ceiling of a building such as a gymnasium or the like, in which case an illumination target is a floor of the gymnasium. When the LED lamp 900 is used for the same purpose, it is required to illuminate the gymnasium floor more uniformly from end to end. However, it is difficult for the LED lamp 900 to provide uniform illumination since the plurality of LED modules 902 is discretely arranged.

SUMMARY

The present disclosure provides some embodiments of an LED lamp which is capable of providing more uniform illumination, and a lens unit for the LED lamp.

According to one embodiment of the present disclosure, there is provided an LED lamp including: a plurality of light source units, each of which includes one or more LED chips and an emission surface through which light from the LED chips is emitted; and a lens unit having a plurality of lenses, each of which is located in front of the emission surface of each of the plurality of light source units.

In some embodiments, the plurality of lenses is arranged in the form of a matrix.

In some embodiments, the emission surface of each of the plurality of light source units is smaller than an area of each of the lenses.

In some embodiments, each of the lenses is a Fresnel lens and the lens unit has a shape of plate.

In some embodiments, the lens unit has a plurality of partition regions, each of which includes the Fresnel lens.

In some embodiments, the lens unit has a rectangular shape in its entirety.

In some embodiments, each of the partition regions has a rectangular shape.

In some embodiments, the plurality of partition regions includes inner partition regions surrounded by a plurality of other partition regions and each of the inner partition regions has the lens formed in its entire surface.

In some embodiments, a center of the inner partition region coincides with a center of the lens included in the inner partition region.

In some embodiments, the plurality of partition regions includes outer partition regions having portions not surrounded by the plurality of other partition regions and a center of each of the outer partition regions is deviated from a center of the lens included in each of the outer partition regions in an outward direction.

In some embodiments, the outer partition regions have non-lens portions in their outer portions, the non-lens portions not being formed with the lenses.

In some embodiments, each of the outer partition regions has the lens formed in its entire surface.

In some embodiments, a distance between each of the lenses and each of the light source units is smaller than a focal length of each of the lenses.

In some embodiments, the LED lamp further includes a plurality of light source substrates, each of which is mounted with a part of the plurality of light source units.

In some embodiments, the one or more LED chips are directly mounted on the light source substrates.

In some embodiments, each of the light source units has a fluorescent resin part covering the one or more LED chips and containing a fluorescent material emitting light having a wavelength different from that of the light from the one or more LED chips when the fluorescent material is excited by the light from the one or more LED chips.

In some embodiments, each of the light source units has a rectangular shape.

In some embodiments, each of the light source units has a plurality of LED chips arranged in the form of a matrix.

In some embodiments, each of the plurality of light source substrates has an elongated rectangular shape and the plurality of light source substrates are arranged in parallel to each other at intervals.

In some embodiments, the plurality of LED chips included in each of the light source units is connected in parallel, and the plurality of light source units mounted on each of the light source substrates is connected in series.

In some embodiments, the LED lamp further includes a heat transfer plate to which the plurality of light source substrates is attached.

In some embodiments, the LED lamp further includes a housing configured to support the heat transfer plate.

In some embodiments, the housing has an attachment opening formed in an opposite side to the heat transfer plate to which the plurality of light source substrates is attached, and an attachment is attached to the attachment opening.

In some embodiments, the LED lamp further includes a protective plate located in an opposite side to the plurality of light source units with respect to the lens units.

According to another embodiment of the present disclosure, there is provided a lens unit for LED lamp, including a plurality of lenses arranged in the form of a matrix, each of which transmits and emits light from a light source unit.

In some embodiments, each of the lenses is a Fresnel lens and the lens unit has a shape of plate in its entirety.

In some embodiments, the lens unit has a plurality of partition regions, each of which includes the Fresnel lens.

In some embodiments, the lens unit has a rectangular shape in its entirety.

In some embodiments, each of the partition regions has a rectangular shape.

In some embodiments, the plurality of partition regions includes inner partition regions surrounded by a plurality of other partition regions and each of the inner partition regions has the lens formed in its entire surface.

In some embodiments, a center of the inner partition region coincides with the center of the lens included in the inner partition region.

In some embodiments, the plurality of partition regions includes outer partition regions having portions not surrounded by the plurality of other partition regions and a center of each of the outer partition regions is deviated from a center of the lens included in each of the outer partition regions in an outward direction.

In some embodiments, the outer partition regions have non-lens portions in their outer portions, the non-lens portions not being formed with the lenses.

In some embodiments, each of the outer partition regions has the lens formed in its entire surface.

Other features and advantages of the present disclosure will be apparent from the following detailed description in conjunction with the accompanying drawings.

DETAILED DESCRIPTION

Figure 1:
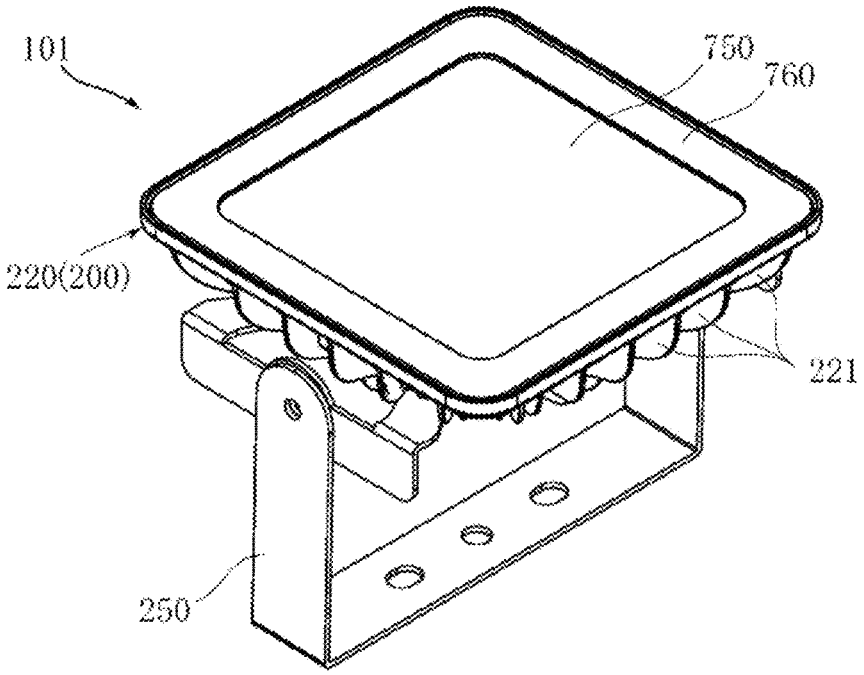
FIG. 1 is a perspective view showing an LED lamp according to a first embodiment of the present disclosure.

Reference will now be made in detail to various embodiments, examples of which are illustrated in the accompanying drawings. In the following detailed description, numerous specific details are set forth in order to provide a thorough understanding of the present invention(s). However, it will be apparent to one of ordinary skill in the art that the present invention(s) may be practiced without these specific details. In other instances, well-known methods, procedures, systems, and components have not been described in detail so as not to unnecessarily obscure aspects of the various embodiments.

Embodiments of the present disclosure will now be described in detail with reference to the drawings.

FIGS. 1 to 7 show an LED lamp 101 according to a first embodiment of the present disclosure. The LED lamp 101 of the first embodiment includes a support member 200, a plurality of light source substrates 300, a plurality of light source units 500, a lens plate 701, a protective plate 750 and a resin frame 760. For example, the LED lamp 101 has a planar dimension of 250×250 mm or so, a height of 90 mm or so when a stay 250 (which will be described later) is excluded, a weight of 2 kg or so, power consumption of 95 W or so, and the total light flux of 110001 m or so, and is intended to be used as a substitute for a mercury lamp.

Figure 2:
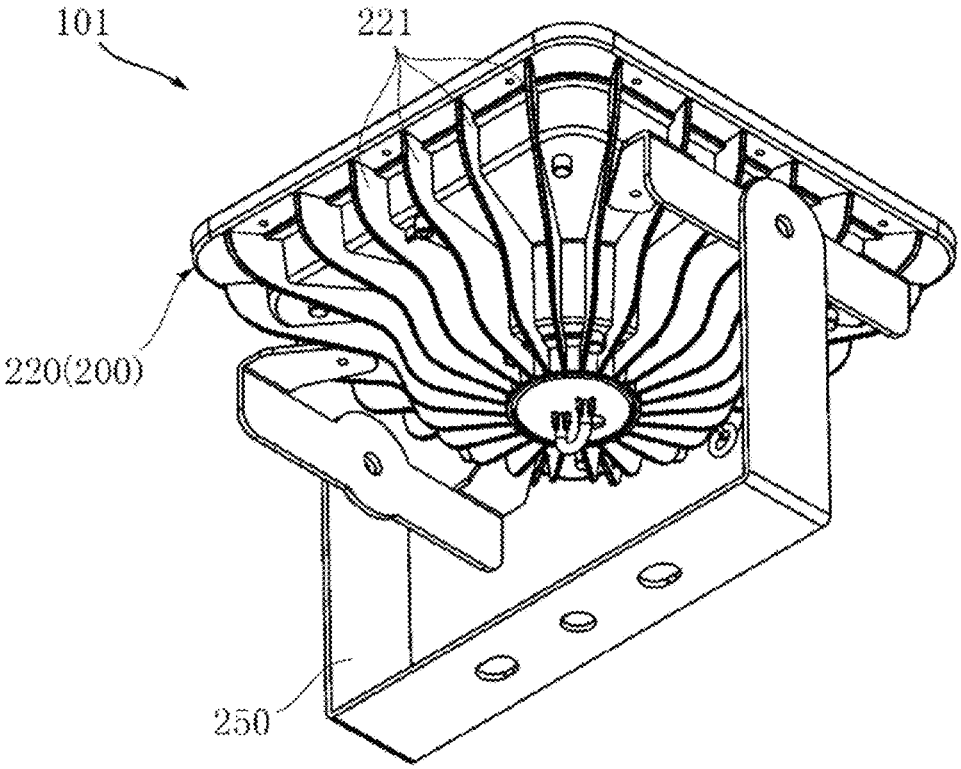
FIG. 2 is a perspective view of the LED lamp of FIG. 1, viewed from a different angle.
Figure 3:
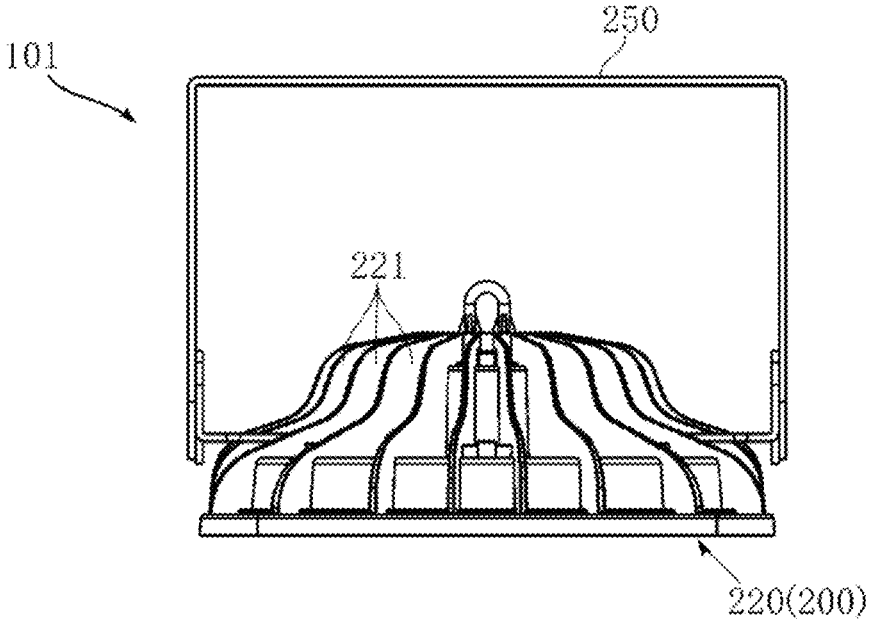
FIG. 3 is a front view showing the LED lamp of FIG. 1.
Figure 4:
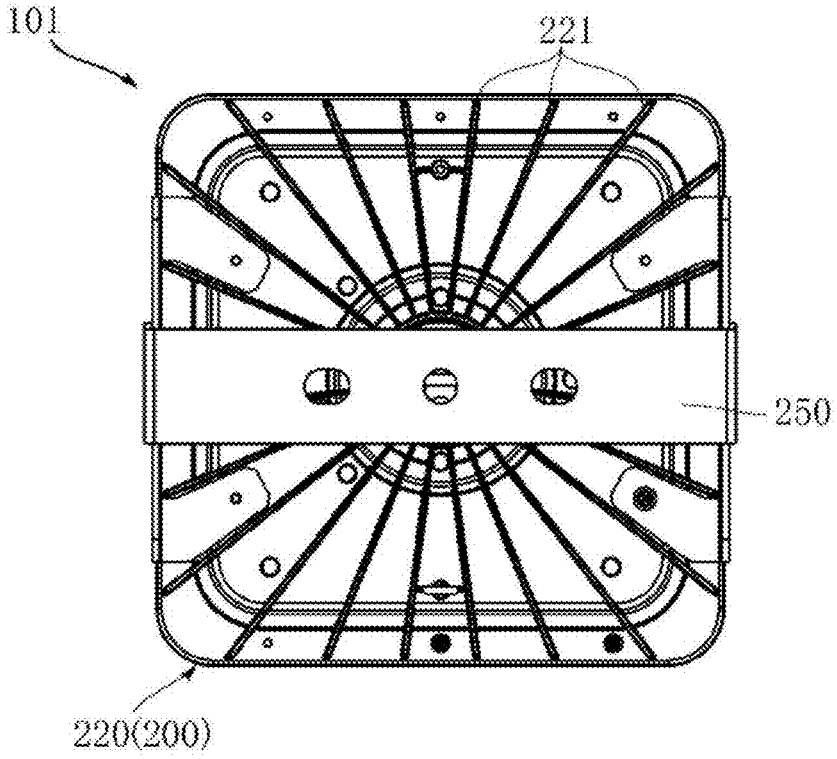
FIG. 4 is a bottom view showing the LED lamp of FIG. 1.

The support member 200 includes a heat transfer plate 210 and a housing 220. The support member 200 occupies most of an external appearance of the LED lamp 101. The housing 220 includes a rectangular shallow box-like housing recess 223 and a plurality of heat-radiating fins 221. The housing recess 223 accommodates the plurality of light source substrates 300, the lens plate 701, the protective plate 750 and the resin frame 760. The plurality of heat-radiating fins 221 is arranged in a radial fashion when viewed from the top as shown in FIG. 4. Each of the heat-radiating fins 221 has a slender mountain shape as shown in FIGS. 2 and 3. The housing 220 is preferably made of aluminum due to its lightness and high heat radiation ability, although it may be made of other metals, such as magnesium or the like, instead of aluminum. Alternatively, the housing 220 may be made of resin having a relatively high thermal conductivity and a metal member such as aluminum sealed in the resin.

Figure 6:
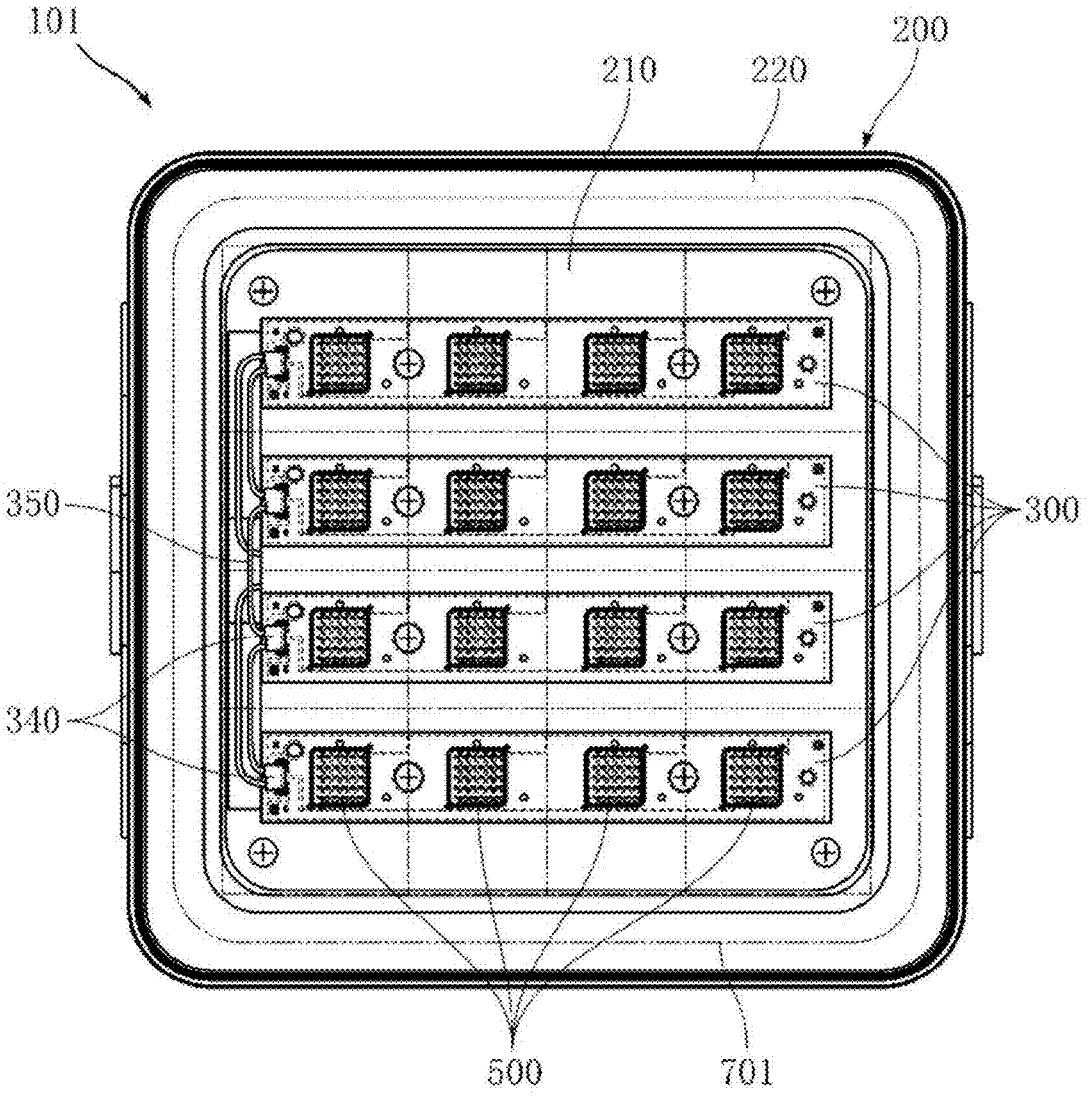
FIG. 6 is a main part plan view showing the LED lamp of FIG. 1.
Figure 7:
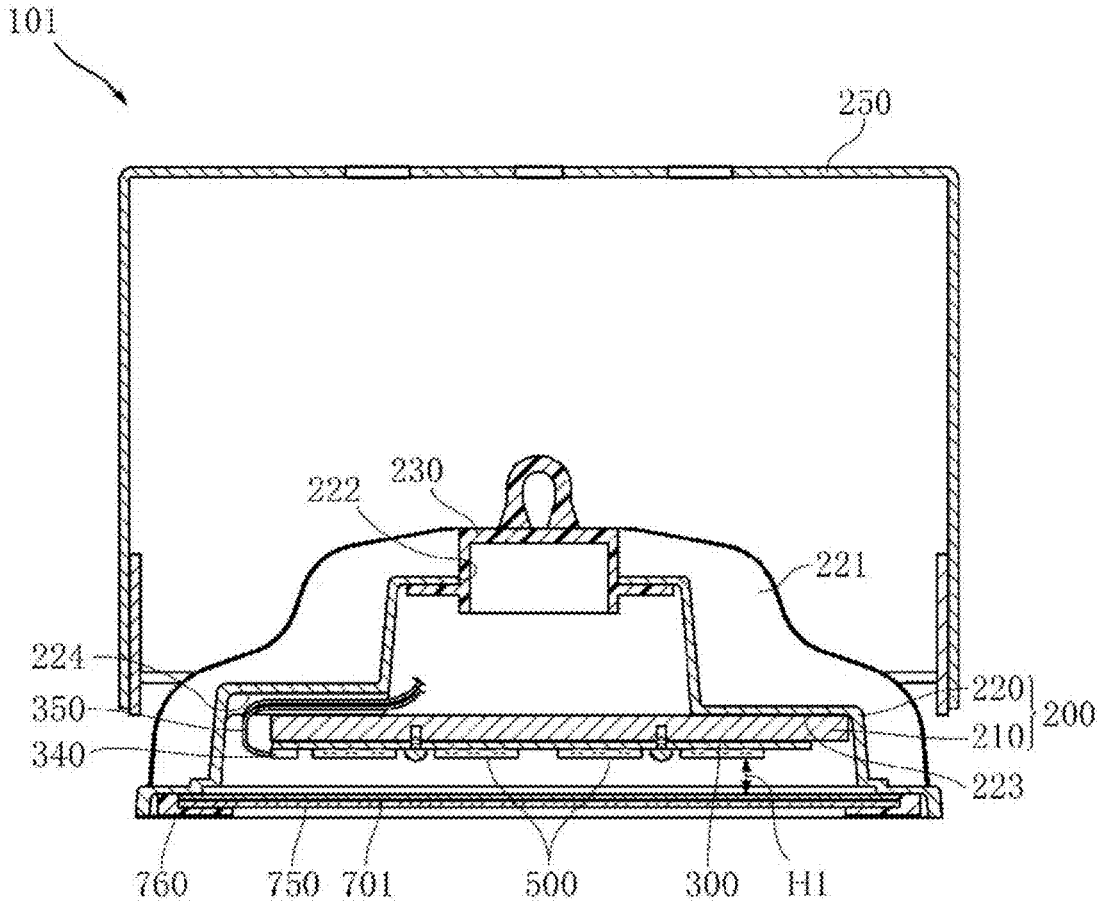
FIG. 7 is a sectional view taken along line VII-VII in FIG. 4.

The heat transfer plate 210 is attached to the housing 220, as shown in FIGS. 6 and 7. In this embodiment, the heat transfer plate 210 has a shape of a rectangular plate having partial cutouts at its corner portions. In this embodiment, the heat transfer plate 210 is preferably made of aluminum due to its lightness and high heat radiation ability, although it may be made of other metals, such as magnesium or the like, instead of aluminum.

Without being limited to the above separated structure of the heat transfer plate 210 and the housing 220, the support member 200 may be, for example, an integrated mold having parts corresponding to the heat transfer plate 210 and the housing 220.

In this embodiment, a stay 250 is attached to the housing 220 of the support member 200. The stay 250 is formed by bending a metal plate and is used to fix the LED lamp 101 to a desired ceiling surface, wall surface or the like.

In addition, an attachment opening 222 is formed in the housing 220 of this embodiment, as shown in FIG. 7. The attachment opening 222 is formed opposite to a side where the housing recess 223 is opened. An attachment 230 is attached to the attachment opening 222. The attachment 230 is used to attach the LED lamp 101 to an attachment target (not shown). The attachment 230 of this embodiment is made of an insulating resin and has a ring-like part usable to hang the LED lamp 101. For example, if the LED lamp 101 is attached to a power feed part (not shown) to which an E39 type lamp cap complying with the JIS standards can be attached, the attachment 230 adaptive for the E39 type standard may be attached to the housing 220.

Figure 9:
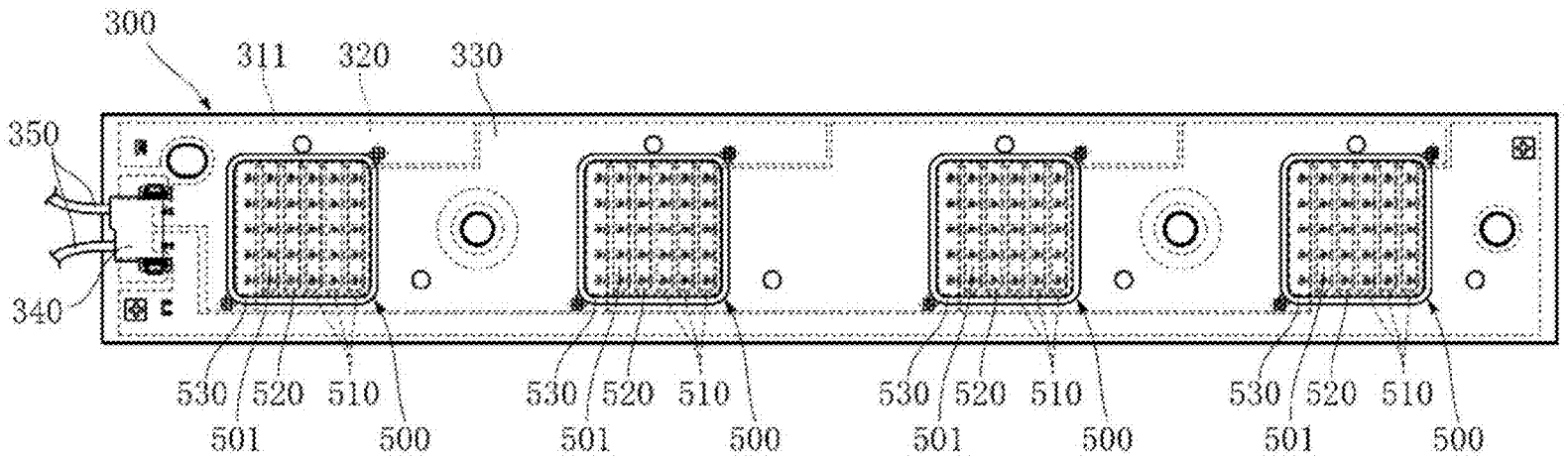
FIG. 9 is a plan view showing a light source substrate of the LED lamp of FIG. 1.
Figure 10:
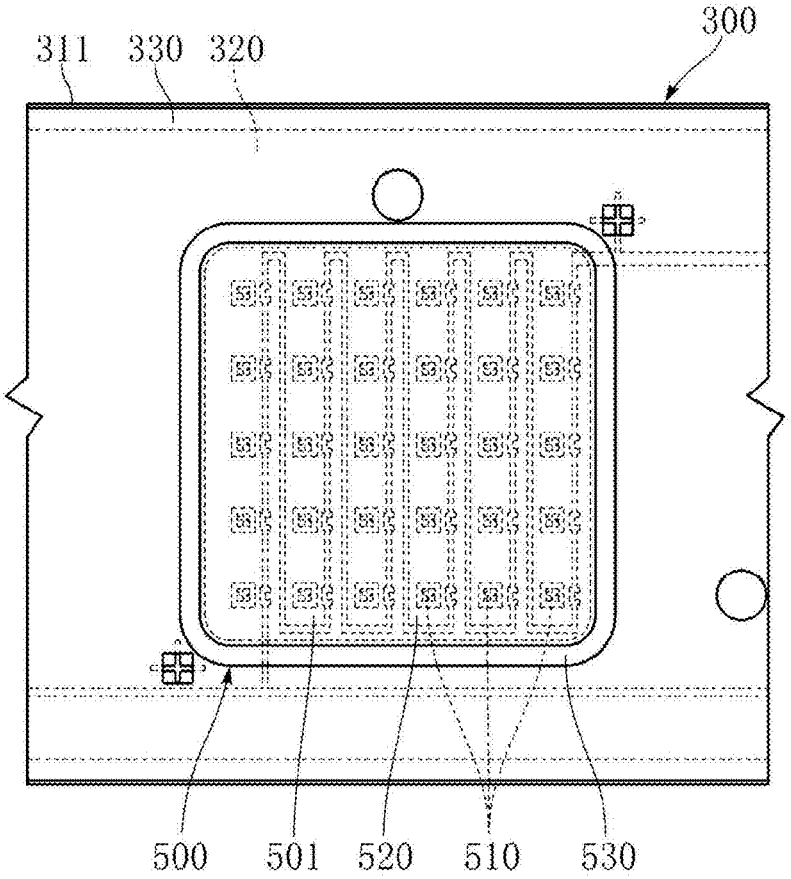
FIG. 10 is a main part-enlarged plan view showing the light source substrate of the LED lamp of FIG. 1.
Figure 11:
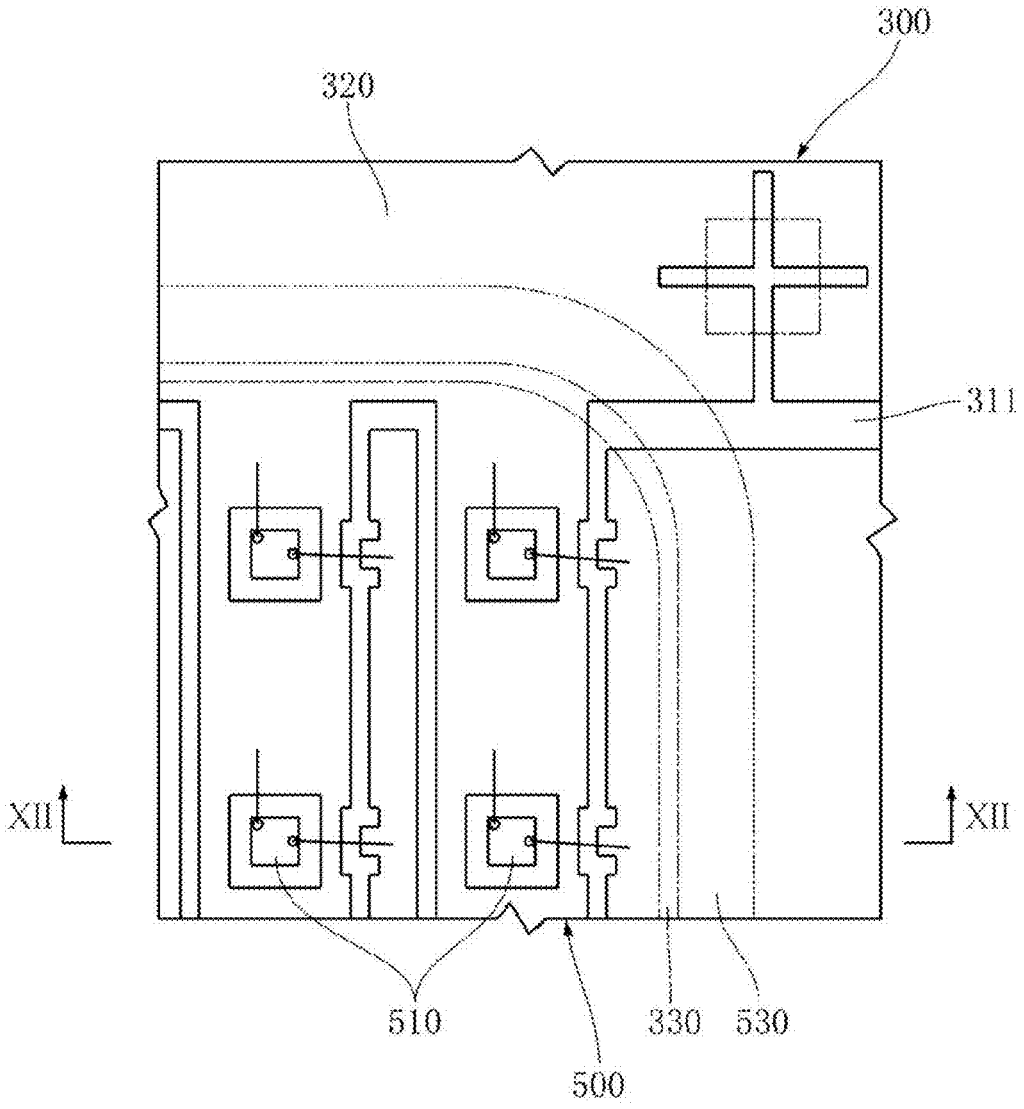
FIG. 11 is a main part-enlarged plan view showing the light source substrate of the LED lamp of FIG. 1.
Figure 12:
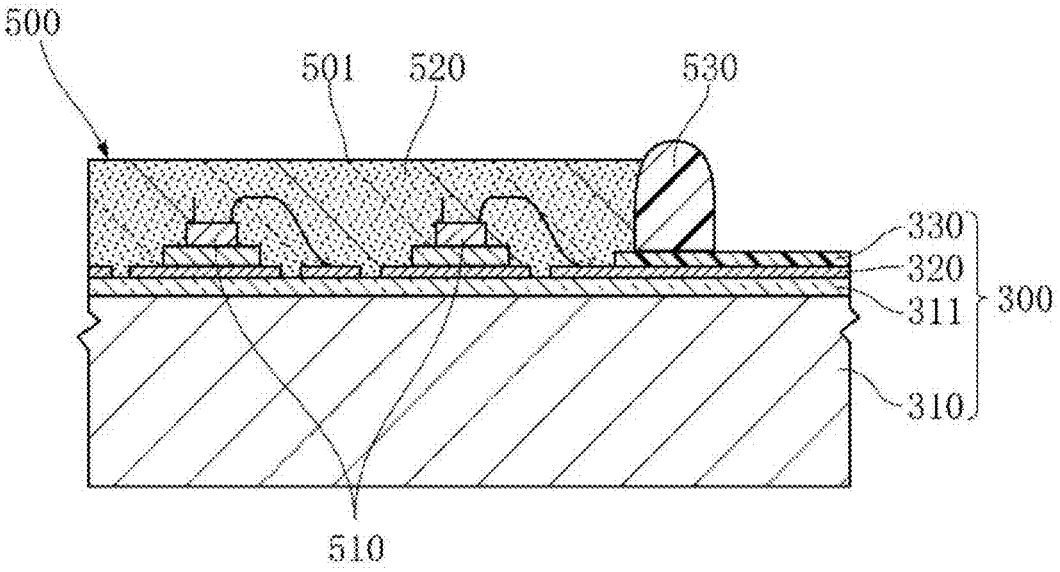
FIG. 12 is a main part-enlarged sectional view taken along line XII-XII in FIG. 11.

As shown in FIGS. 6 and 9, each of the plurality of light source substrates 300 is mounted thereon with a plurality of light source units 500 and is supported to the heat transfer plate 210 of the support member 200. Each light source substrate 300 has a rectangular shape when viewed from the top and includes a base 310, an insulating layer 311, a wiring pattern 320 and a resist layer 330. The base 310 is made of, for example, aluminum. The insulating layer 311 covers at least one side of the base 310 and is formed of, for example, an insulating resin or aluminum oxide film. The wiring pattern 320 is used to supply power to the light source units 500 and is formed on the insulating layer 311. The resist layer 330 covers most of the portions of the base 310, the insulating layer 311 and the wiring pattern 320, exposed from the light source units 500. In this embodiment, the resist layer 330 is made of a white insulating resin. In this embodiment, four light source substrates 300 are arranged in parallel. Each light source substrate 300 is fixed to the heat transfer plate 210 by means of screws.

The plurality of light source units 500 is mounted on the light source substrate 300, each of which includes a plurality of LED chips 510, a fluorescent resin part 520 and a dam 530. In this embodiment, four light source units 500 are arranged for each light source substrate 300 in a longitudinal direction of the light source substrate 300. Thus, 16 light source units 500 are arranged in the form of a 4×4 matrix. In this embodiment, each light source unit 500 has a rectangular shape when viewed from the top and includes a rectangular emission surface 501. For example, white light is emitted from the emission surface 501. The dimension of the emission surface 501 is, for example, a square of 16 mm×16 mm.

The plurality of LED chips 510 is directly mounted on the light source substrate 300 and is made of, for example, a GaN-based semiconductor to emit blue light. In this embodiment, each LED chip 510 is of a so-called two-wire type in which it makes electrical conduction with the wiring pattern 320 of the light source substrate 300 by two wires. However, the LED chip 510 may be of a so-called one-wire type or flip chip type, and not limited to the two-wire type. In this embodiment, 30 LED chips 510 are provided for one light source unit 500 and are arranged in the form of a 5×6 matrix.

The fluorescent resin part 520 is made of, for example, a mixture of transparent resin and fluorescent material and covers the plurality of LED chips 510. In this embodiment, the fluorescent material emits yellow light when it is excited by the blue light from the LED chips 510. The light source unit 500 emits the white light by mixing the blue light and the yellow light. A surface of the fluorescent resin part 520 through which the white light is emitted corresponds to the above-mentioned emission surface 501. The fluorescent resin part 520 is surrounded by the dam 530. The dam 530 is made of, for example, a white silicone resin of a rectangular loop shape. Liquid resin material used to form the fluorescent resin part 520 is formed into a desired shape by the dam 530.

Each light source substrate 300 is provided with a connector 340 which makes electrical conduction with the plurality of LED chips 510 via the wiring pattern 320. A cable 350 extends from the connector 340. The cable 350 connects connectors 340 of adjacent light source substrates 300. Some cable 350 extends toward the bottom side of the housing 220 via a cable groove 224 formed in the housing 220, as shown in FIG. 7.

Figure 13:
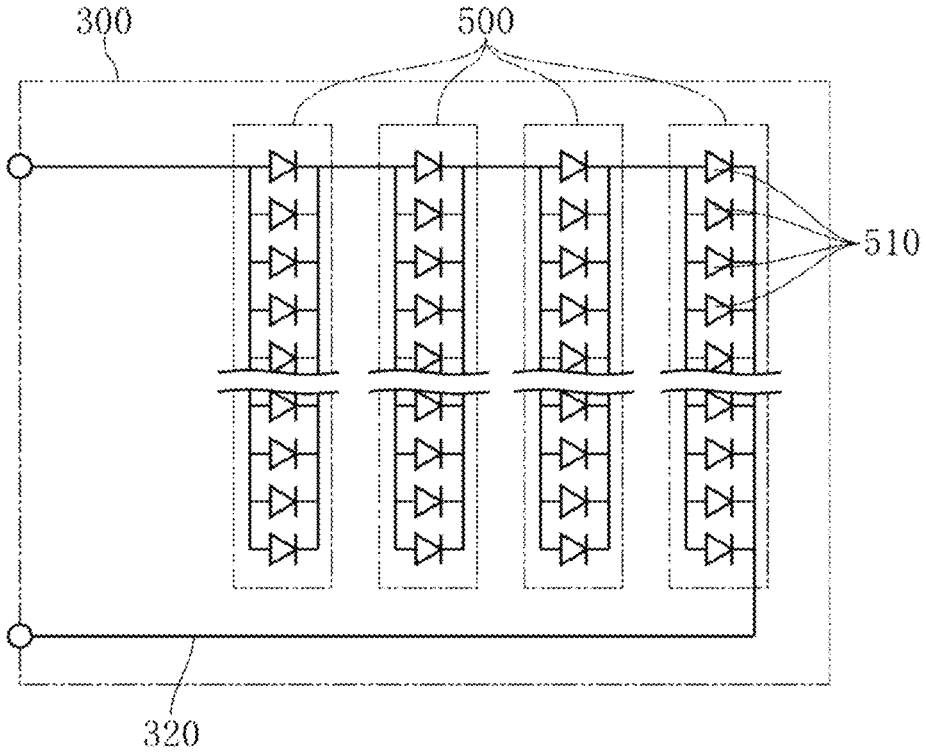
FIG. 13 is a circuit diagram of the light source substrate of the LED lamp of FIG. 1.

FIG. 13 is a circuit diagram of a light source substrate 300. 30 LED chips 510 are connected in parallel in each light source unit 500. Light source units 500 are connected in series in fours. Light source substrates 300 are also connected in series in fours. Thus, 16 light source units 500 are connected in series.

Figure 5:
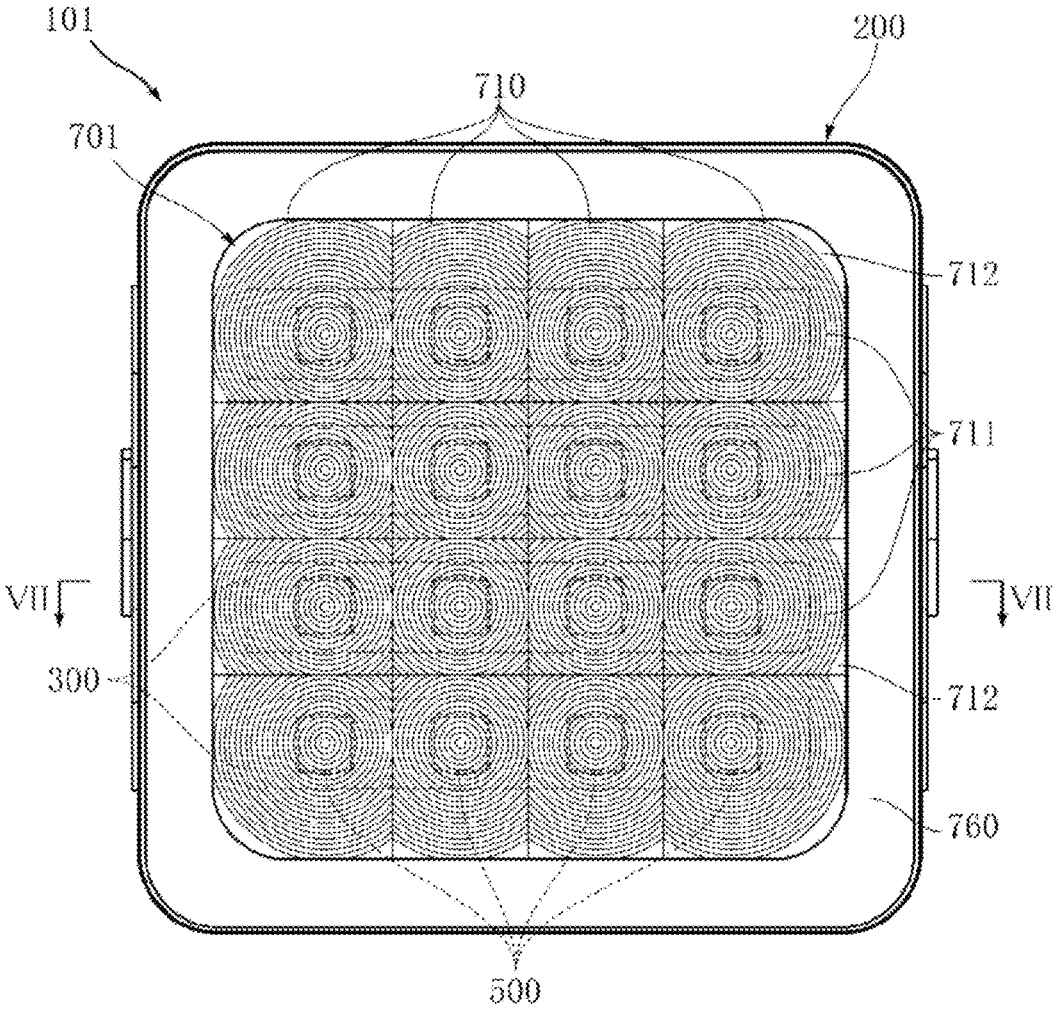
FIG. 5 is a plan view showing the LED lamp of FIG. 1.
Figure 8:
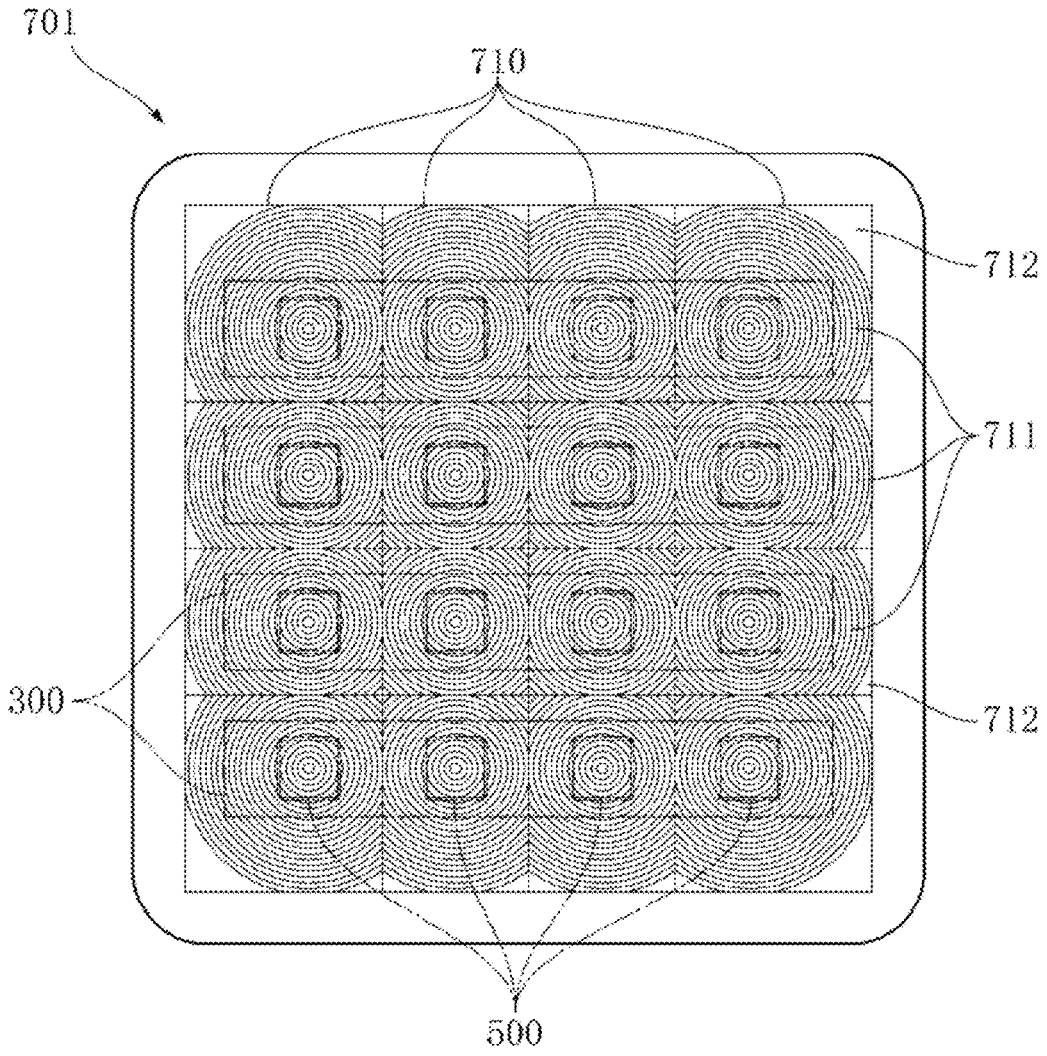
FIG. 8 is a plan view showing a lens plate of the LED lamp of FIG. 1.

As one example of a lens unit, the lens plate 701 is disposed in front of the plurality of light source units 500, as shown in FIG. 7. In this embodiment, the lens plate 701 is made of transparent material of a 220 mm×220 mm squared plate shape and has 16 partition regions 710 as shown in FIGS. 5, 6 and 8. The partition regions 710, each having a rectangular shape, are arranged in the form of a 4×4 matrix. The 4 inner partition regions 710 are surrounded by the other 12 outer partition regions 710. The other 12 outer partition regions 710 surrounding the 4 inner partition regions 710 have portions which are not adjacent to different partition regions 710. Of the other 12 outer partition regions 710, each of four outer partition regions 710 located at four corners has a square shape of 55 mm×55 mm, while each of eight outer partition regions 710 not located at the four corners has a rectangular shape of 41 mm×55 mm.

One Fresnel lens 711 is formed in each partition region 710. The Fresnel lens 711 is an aggregate of a plurality of circular ring-like lens surfaces and serves to provide enhanced directionality of light from the light source unit 500. In this embodiment, a focal length of the Fresnel lens 711 is 50 mm. When viewed from the top, the centers of the inner 4 partition regions 710 coincide with the centers of the respective Fresnel lenses 711 included therein. The centers of Fresnel lenses 711 included in the outer 12 partition regions 710 are inward shifted from the centers of the outer 12 partition regions 710. As shown in FIGS. 5, 6 and 8, the centers of the 16 Fresnel lenses 711 coincide with the centers of the 16 light source units 500. Thus, the 16 Fresnel lenses 711 are arranged in the form of an equal-pitched matrix. In addition, when viewed from the top, the Fresnel lenses 711 are larger than the light source units 500. Each of the outer 12 partition regions 710 has a non-lens portion 712. The non-lens portion 712 corresponds to a non-lens functional portion located in an outer edge of the corresponding partition region 710 and an outer edge of the corresponding Fresnel lens 711.

The protective plate 750 is made of transparent material and is disposed in an opposite side to the light source units 500 with respect to the lens plate 701. For the purpose of clarity, the protective plate 750 is not shown in FIG. 5. The protective plate 750 is used to protect the lens plate 701. The resin frame 760 is a frame-like member made of an opaque resin and is used to fix the protective plate 750 and the lens plate 701 to the housing 220.

Figure 14:
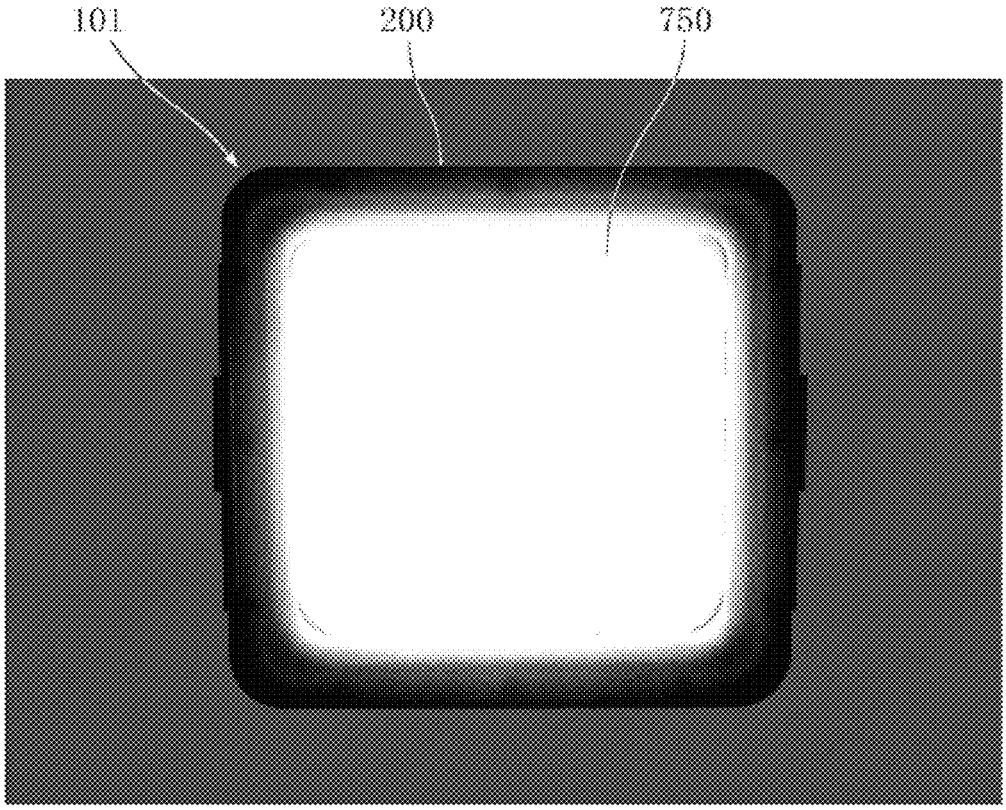
FIG. 14 is a plan view showing a high brightness lighting state of the LED lamp of FIG. 1.
Figure 15:
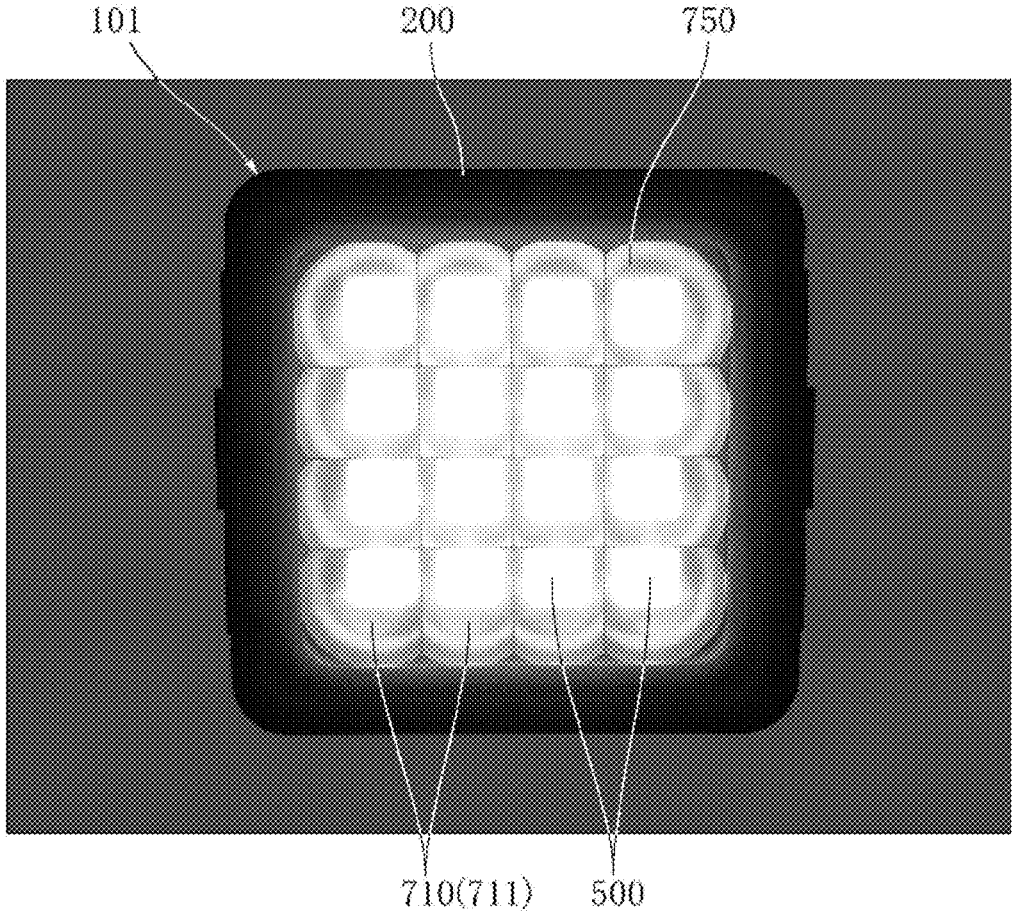
FIG. 15 is a plan view showing a low brightness lighting state of the LED lamp of FIG. 1.

FIG. 14 shows a picture of the LED lamp 101 lit with high brightness, in which the LED lamp 101 assumes an external appearance in which the protective plate 750 seems to be illuminated as a whole. FIG. 15 shows a picture of the LED lamp 101 lit with low brightness. It can be seen from FIG. 15 that light from each light source unit 500 is emitted through the Fresnel lens 711 of each partition region 710. In FIGS. 14 and 15, a distance between the lens plate 701 and the light source unit 500 (a distance H1 shown in FIG. 7) is 20 mm, in which case a light distribution angle (half value width) from the LED lamp 101 is about 55° at both sides and about 58% of a light flux from a plurality of light source units 500 is emitted.

FIGS. 16A to 22B show pictures of an external appearance of the LED lamp 101 when the distance H1 between the Fresnel lens 711 and the light source unit 500 are varied. In FIGS. 16A to 22B, left pictures show a non-lit state and right pictures show a low brightness lit state. For convenience, the protective plate 750 and the resin frame 760 are not shown in FIGS. 16A to 22B.

Table 1 shows the distance H1, the light distribution angle θ and an emission ratio η of the LED lamp 101 shown in FIGS. 16A to 22B. The light distribution angle θ is a measurement of a half value angle of light emitted from the LED lamp 101. The emission ratio η is a ratio of a light flux emitted from the LED lamp 101 through the lens plate 701 to the light flux emitted from the light source unit 500. It can be seen from Table 1 that light distribution angle θ and the emission ratio η increase as the distance H1 becomes smaller than the focal length (50 mm) of the Fresnel lens 711. It can be seen that the distance H1 may be set to be smaller than the focal length of the Fresnel lens 711 if the LED lamp 101 is to be used with a larger light distribution angle θ and a larger emission ratio η. On the other hand, it can be seen that the distance H1 may be set to be closer to the focal length of the Fresnel lens 711 by decreasing the distribution angle θ if a confined portion of an illumination target is to be intensively illuminated.

TABLE 1

Figure 16A:
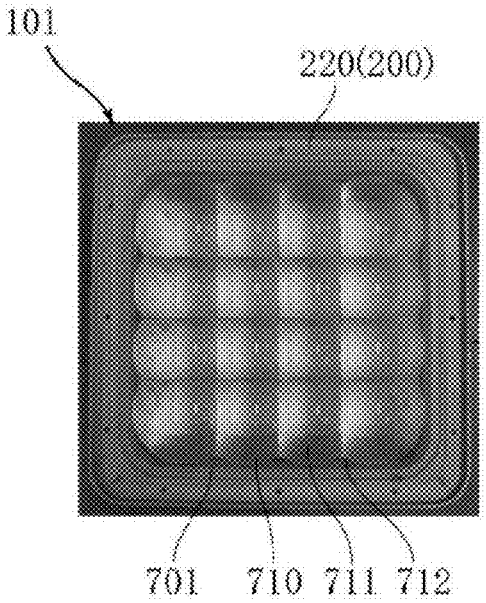
FIG. 16A is a plan view showing a non-lighting state of the LED lamp when a distance between a Fresnel lens of the LED lamp of FIG. 1 and a light source unit has a first value.
Figure 16B:
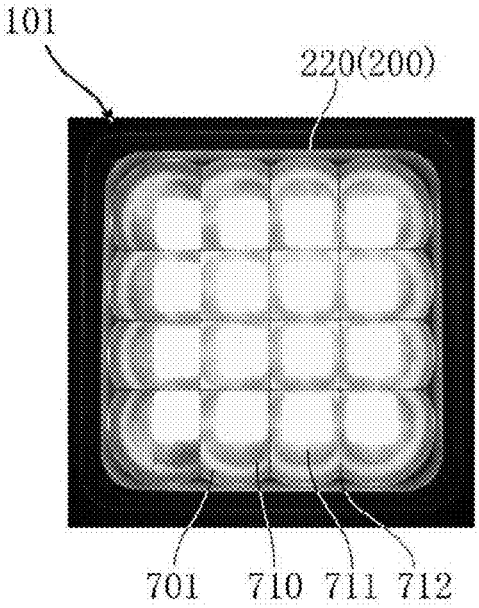
FIG. 16B is a plan view showing a low brightness lighting state of the LED lamp when a distance between a Fresnel lens of the LED lamp of FIG. 1 and a light source unit has a first value.
Figure 17A:
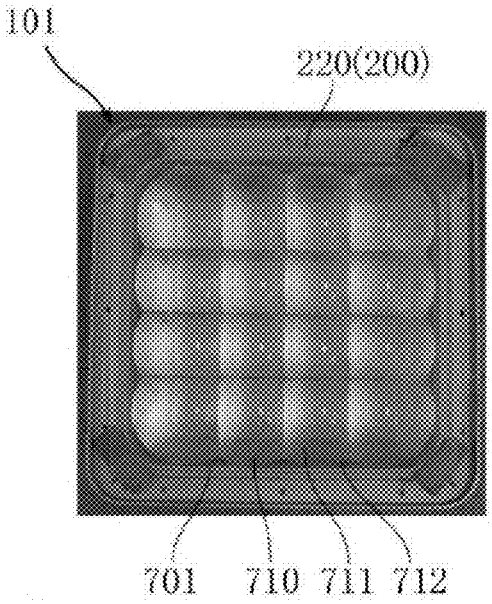
FIG. 17A is a plan view showing a non-lighting state of the LED lamp when a distance between a Fresnel lens of the LED lamp of FIG. 1 and a light source unit has a second value.
Figure 17B:
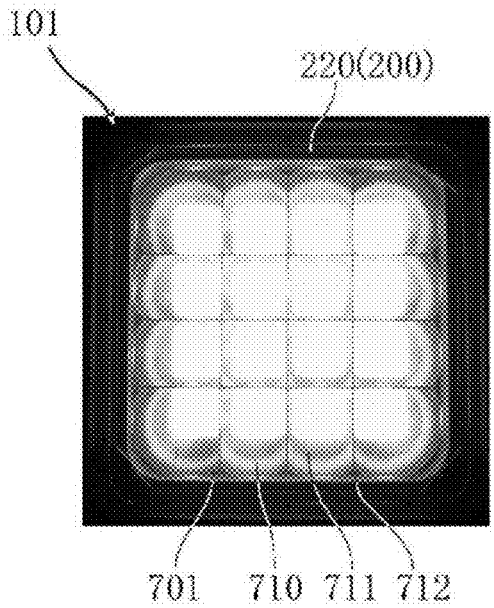
FIG. 17B is a plan view showing a low brightness lighting state of the LED lamp when a distance between a Fresnel lens of the LED lamp of FIG. 1 and a light source unit has a second value.
Figure 18A:
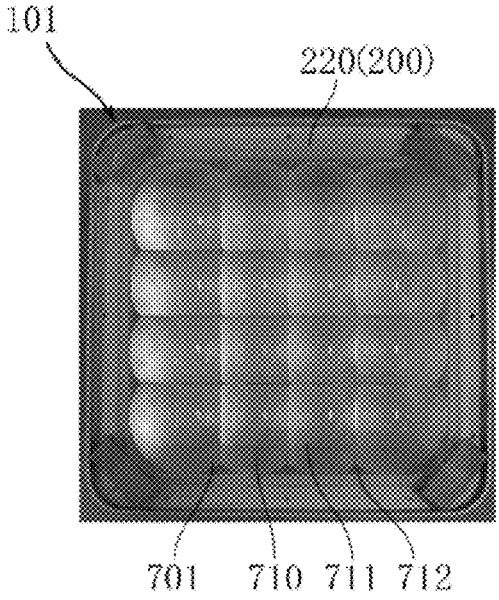
FIG. 18A is a plan view showing a non-lighting state of the LED lamp when a distance between a Fresnel lens of the LED lamp of FIG. 1 and a light source unit has a third value.
Figure 18B:
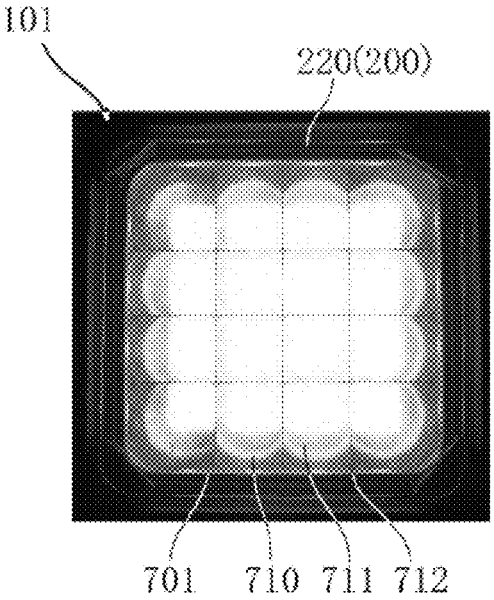
FIG. 18B is a plan view showing a low brightness lighting state of the LED lamp when a distance between a Fresnel lens of the LED lamp of FIG. 1 and a light source unit has a third value.
Figure 19A:
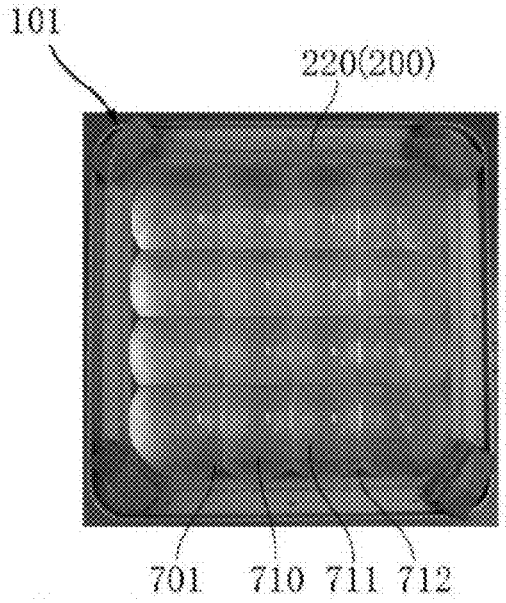
FIG. 19A is a plan view showing a non-lighting state of the LED lamp when a distance between a Fresnel lens of the LED lamp of FIG. 1 and a light source unit has a fourth value.
Figure 19B:
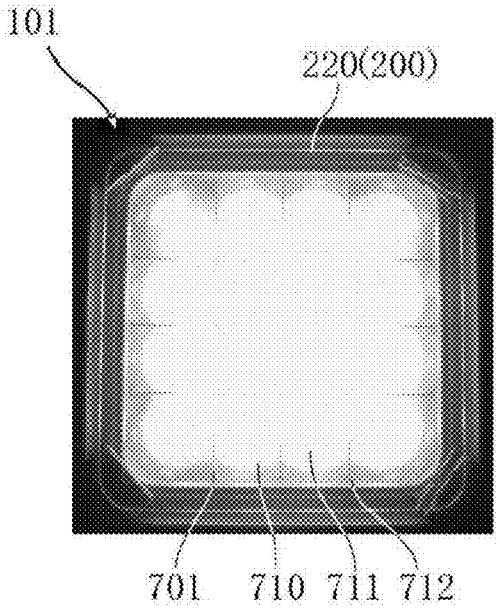
FIG. 19B is a plan view showing a low brightness lighting state of the LED lamp when a distance between a Fresnel lens of the LED lamp of FIG. 1 and a light source unit has a fourth value.
Figure 20A:
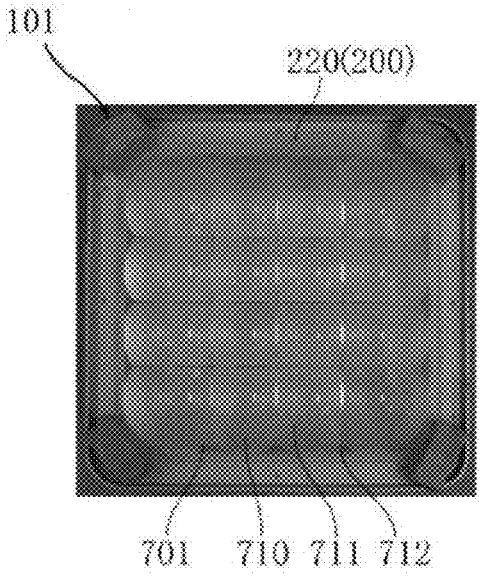
FIG. 20A is a plan view showing a non-lighting state of the LED lamp when a distance between a Fresnel lens of the LED lamp of FIG. 1 and a light source unit has a fifth value.
Figure 20B:
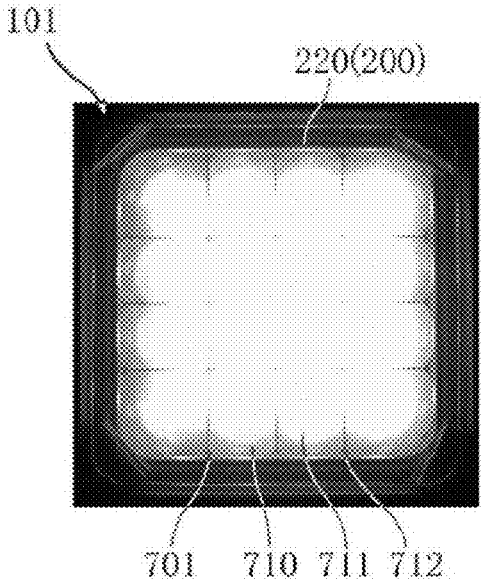
FIG. 20B is a plan view showing a low brightness lighting state of the LED lamp when a distance between a Fresnel lens of the LED lamp of FIG. 1 and a light source unit has a fifth value.
Figure 21A:
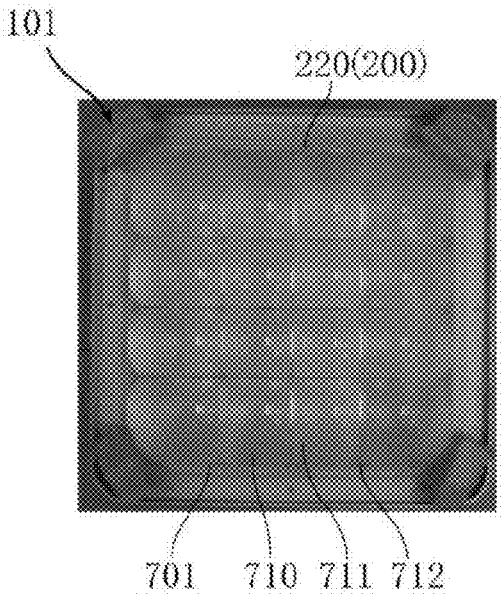
FIG. 21A is a plan view showing a non-lighting state of the LED lamp when a distance between a Fresnel lens of the LED lamp of FIG. 1 and a light source unit has a sixth value.
Figure 21B:
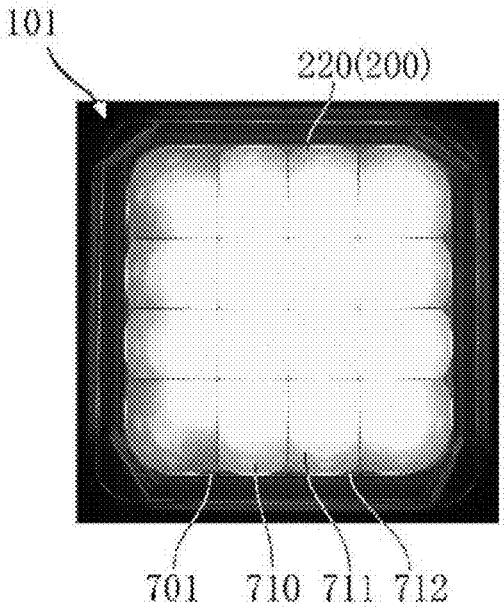
FIG. 21B is a plan view showing a low brightness lighting state of the LED lamp when a distance between a Fresnel lens of the LED lamp of FIG. 1 and a light source unit has a sixth value.
Figure 22A:
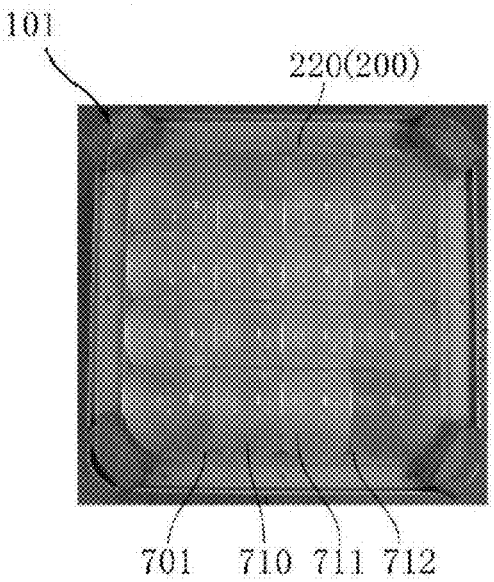
FIG. 22A is a plan view showing a non-lighting on state of the LED lamp when a distance between a Fresnel lens of the LED lamp of FIG. 1 and a light source unit has a seventh value.
Figure 22B:
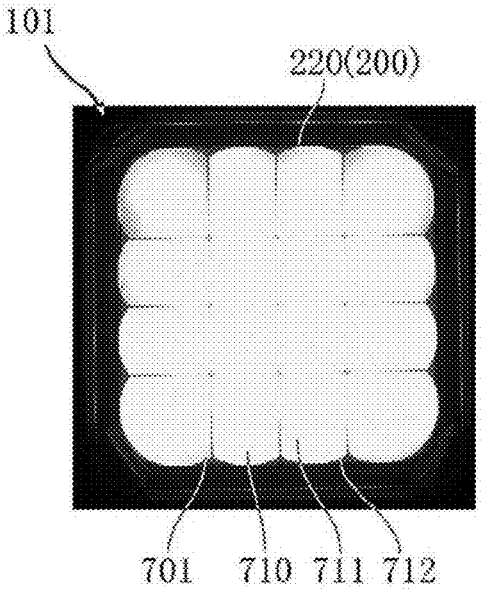
FIG. 22B is a plan view showing a low brightness lighting state of the LED lamp when a distance between a Fresnel lens of the LED lamp of FIG. 1 and a light source unit has a seventh value.

| FIG. No | Distance H1 | Light distribution angle θ | Emission ratio η |
|---|---|---|---|
| FIG. 16 | 20 mm | 55° | 58% |
| FIG. 17 | 25 mm | 45° | 46% |
| FIG. 18 | 30 mm | 35° | 38% |
| FIG. 19 | 35 mm | 25° | 31% |
| FIG. 20 | 40 mm | 22° | 25% |
| FIG. 21 | 45 mm | 20° | 21% |
| FIG. 22 | 50 mm | 16° | 18% |

An operation of the lens plate 701 and the LED lamp 101 will be now described.

According to this embodiment, a plurality of Fresnel lenses 711 is located in front of each of a plurality of light source units 500. This allows light from the plurality of light source units 500 to be collected by the plurality of Fresnel lenses 711. Thus, the light from the plurality of light source units 500 is more uniformly emitted. Accordingly, for example, a gymnasium floor or the like can be more uniformly illuminated with the LED lamp 101.

The arrangement of the plurality of Fresnel lenses 711 in the form of a matrix allows the light from the plurality of light source units 500 to be more uniformly emitted. Since the emission surface 501 of each light source unit 500 is smaller than each Fresnel lens 711 when viewed from the top, light emitted from the emission surface 501 can be more incident into the Fresnel lens 711 located in front of the emission surface 501. When the plurality of Fresnel lenses 711 is arranged in the LED lamp 101, light incident from a light source unit 500 into an adjacent Fresnel lens 711 cannot be collected. In some embodiments, to avoid light that is not collected traveling in an unintended direction to wrongfully illuminate a region which is not desired to be illuminated and for uniform illumination of a region intended by the LED lamp 101, it is preferable to make light more incident from each light source unit 500 into corresponding Fresnel lens 711 located in front of the light source unit 500.

When a lens unit is configured as the lens plate 701 including the Fresnel lens 711 as in the present disclosure, the LED lamp 101 can be thinned. In addition, as one example method for realizing the LED lamp 101 shown in FIGS. 22A and 22B, the focal length of the Fresnel lens 711 may be set to 20 mm or so with the distance H1 of 20 mm unchanged, which may thin the LED lamp 101. In addition, when the Fresnel lens 711 has a different focal length, for example, the housing 220 does not need to be reconstructed, which may result in cost reduction.

When the LED lamp 101, the lens plate 701, the plurality of partition regions 710 and the plurality of light source units 500 are made in the rectangular form, the plurality of partition regions 710 and the plurality of light source units 500 can be arranged without producing an inappropriate gap therebetween, which further contributes to achieving to uniform illumination by the LED lamp 101.

When the center of each Fresnel lens 711 coincides with the center of the light source unit 500, the light from the light source unit 500 can be collected. When the centers of the above-mentioned inner 4 partition regions 710 coincide with the centers of the respective Fresnel lenses 711 included therein, light can be uniformly emitted from these partition regions 710. On the other hand, when the centers of the Fresnel lenses 711 included in the above-mentioned outer 12 partition regions 710 are inward shifted from the centers of the outer 12 partition regions 710, the centers of the 16 Fresnel lenses 711 coincide with the centers of the 16 light source units 500, which is desirable for uniform illumination. In addition, when the centers of the Fresnel lenses 711 included in the outer 12 partition regions 710 are inward shifted from the centers of the outer 12 partition regions 710, the Fresnel lenses 711 may be located in a region somewhat expanded outward from the centers of the light source units 500, which allows the light from the plurality of light source units 500 to be more incident into the plurality of Fresnel lenses 711.

When the plurality of light source substrates 300 is arranged at intervals, costs can be further reduced as compared to a configuration employing one light source substrate having the same size as the lens plate 701, for example. When each light source unit 500 includes the plurality of LED chips 510, more uniform light can be emitted from the entire region of the emission surface 501. The arrangement of LED chips in the form of a matrix is suitable for emission of more uniform light from the entire region of the emission surface 501. Studies show that unbalanced pitches of a plurality of LED chips 510 may cause a so called color separation in a corresponding LED lamp. In the LED lamp 101, such color separation can be avoided since the pitches of the plurality of LED chips 510 are substantially uniform in vertical and horizontal directions.

When the LED chips 510 are directly mounted on the light source substrate 300, heat from the LED chips 510 can be quickly transferred to the light source substrate 300. When the base 310 of the light source substrate 300 is made of aluminum, heat radiation from the LED chips 510 can be promoted. When a plurality of light source substrates 300 is attached to the heat transfer plate 210 which is then attached to the housing 220, heat from the plurality of LED chips 510 can be appropriately transferred to the housing 220 via the heat transfer plate 210. A plurality of heat-radiating fins 221 of the housing 220 is preferable for promotion of heat radiation.

Figure 23:
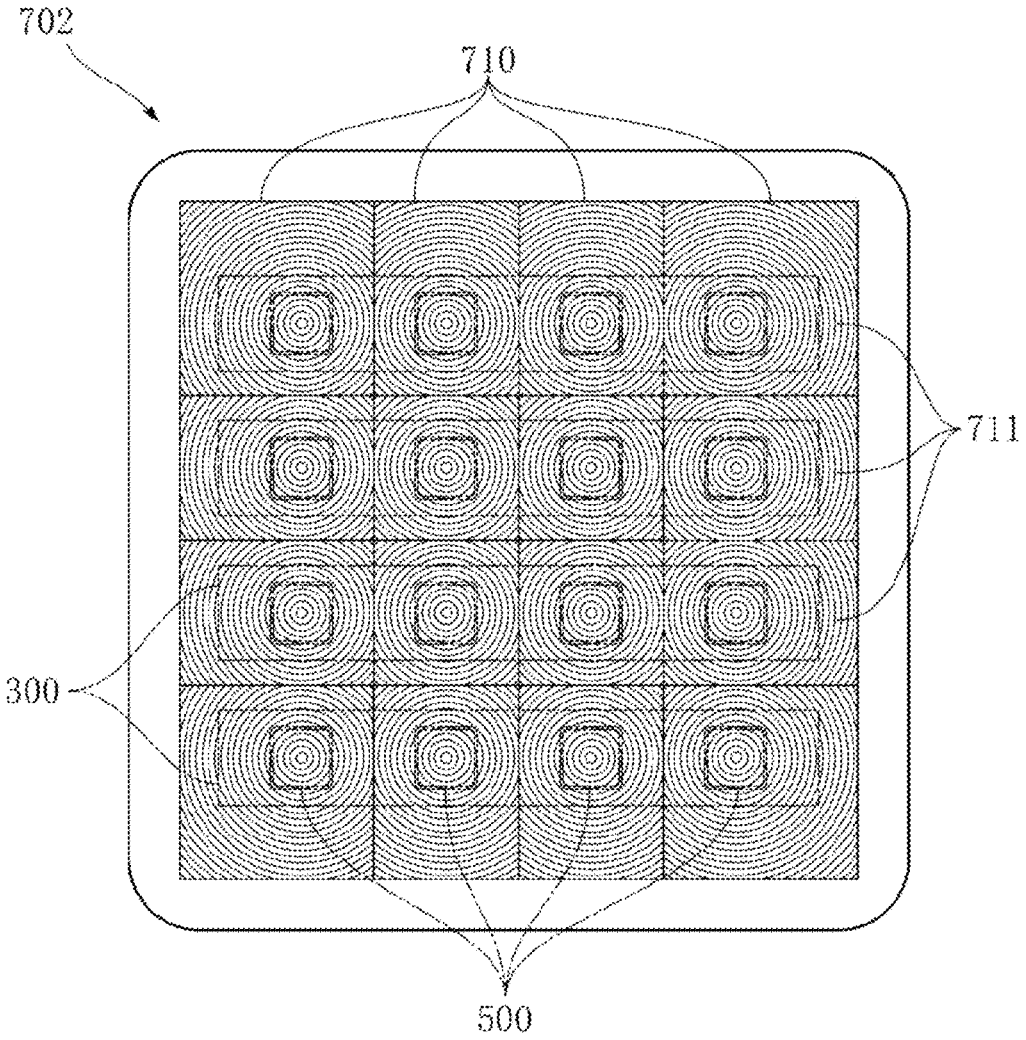
FIG. 23 is a plan view showing another example of the lens plate.
Figure 24:
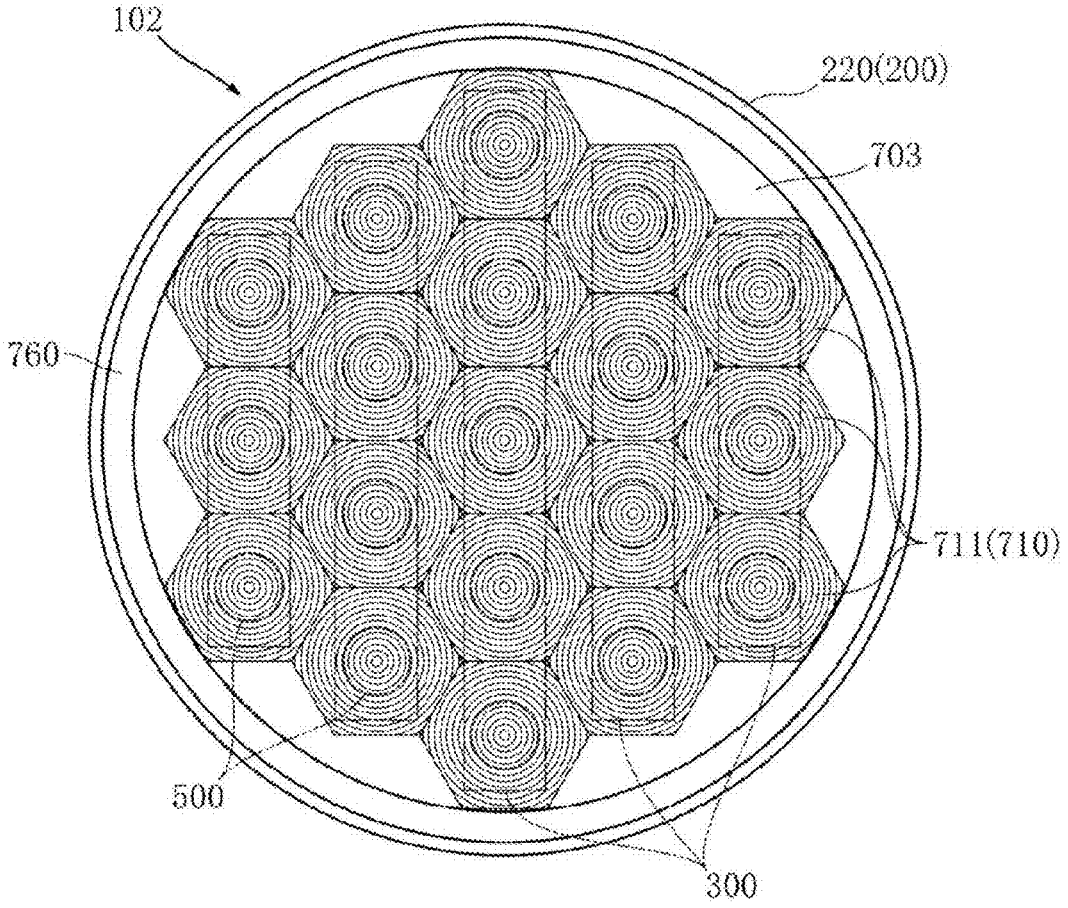
FIG. 24 is a plan view showing an LED lamp according to a second embodiment of the present disclosure.
Figure 25:
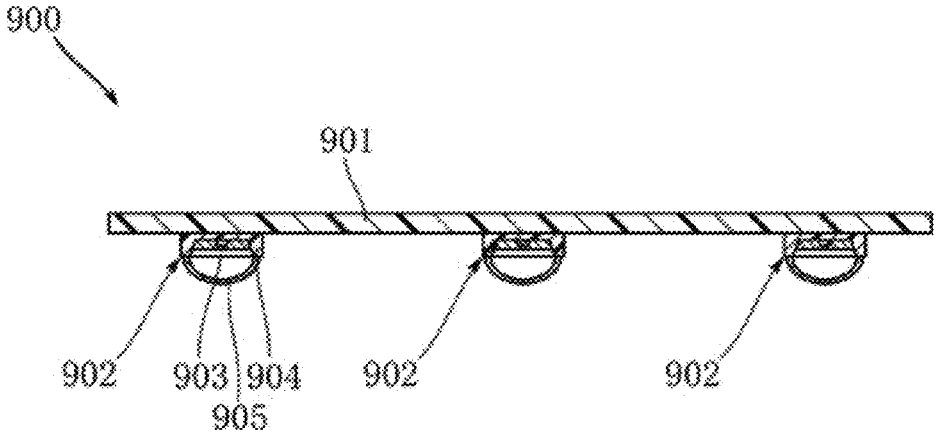
FIG. 25 (PRIOR ART)
FIG. 25 is a sectional view showing a conventional LED lamp.

FIGS. 23 and 24 show another embodiment of the present disclosure. In FIGS. 23 and 24, the same or similar elements as the above-described embodiment are denoted by the same reference numerals as the above-described embodiments.

FIG. 23 shows another example of the lens unit according to the present disclosure. As shown in FIG. 23, a lens plate 702 has Fresnel lenses 711 formed in the partition regions 710. Unlike the above-described embodiment, the Fresnel lenses 711 included in the lens plate 702 do not have non-lens portions 712. This configuration allows the light from the light source units 500 to be more collected for emission to an illumination target.

FIG. 24 shows an LED lamp according to a second embodiment of the present disclosure. In this embodiment, an LED lamp 102 has a circular shape when viewed from the top. For the purpose of easy understanding, the protective plate 750 is not shown in FIG. 24. The LED lamp 102 includes a lens plate 703. The lens plate 703 has a circular shape when viewed from the top. The lens plate 703 has a plurality of partition regions 710. In this embodiment, each partition region 710 has a regular hexagonal shape. The plurality of partition regions 710 is arranged at equal pitches with no gap therebetween. Each partition region 710 has a Fresnel lens 711 formed in its entire area. A plurality of light source units 500 is arranged in the form of a matrix in such a manner that the centers thereof coincide with the centers of the plurality of Fresnel lenses 711. In this embodiment, the plurality of light source units 500 is individually mounted on a plurality of light source substrates 300. The plurality of light source substrates 300 is arranged in parallel in a manner spaced apart from each other.

According to this embodiment, the LED lamp 102 can be used to illuminate a gymnasium floor more uniformly, for example. In addition, as can be understood from this embodiment, the arrangement of a matrix form recited in the present disclosure means regular discrete arrangement on any plane without being limited to arrangement of a rectangular form.

The LED lamp and the LED lamp lens unit according to the present disclosure are not limited to the above-described embodiments. Details of parts of the LED lamp according to the present disclosure may be changed in design in various ways.

A lens recited in the present disclosure is, preferably, a Fresnel lens 711 but, without being limited thereto, may be, for example, a general convex lens or the like. A lens unit recited in the present disclosure is, typically, a lens plate 701 to 703 having a plurality of Fresnel lenses 711 but, without being limited thereto, may be configured to include a plurality of lenses recited in the present disclosure.

A light source unit recited in the present disclosure is, preferably, configured to include a plurality of LED chips 510 directly mounted on a light source substrate 300 but, without being limited thereto, may be, for example, a so-called LED module including one or more LED chips and terminals mounted in the light source substrate 300. In this case, a surface of a portion through which light from the LED module is emitted corresponds to an emission surface recited in the present disclosure.

According to the configuration of the present disclosure, the plurality of lenses is located in front of each of the plurality of light source units. This allows light from the plurality of light source units to be collected by the plurality of lenses. Thus, the light from the plurality of light source units is more uniformly emitted. Accordingly, for example, a gymnasium floor or the like can be more uniformly illuminated with the LED lamp.

While certain embodiments have been described, these embodiments have been presented by way of example only, and are not intended to limit the scope of the disclosures. Indeed, the novel methods and apparatuses described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. An LED illumination apparatus comprising:

a plurality of light source units including a plurality of LED chips, each of the plurality of LED chips having an emission surface through which a light is emitted from each of the plurality of LED chips; and a lens unit having a plurality of lenses, each of the plurality of lenses being located in front of the emission surfaces of the plurality of LED chips of each of the plurality of light source units, the lens unit including inner regions and outer regions surrounding the inner regions, wherein a size of each of the outer regions is larger than a size of each of the inner regions.

2. The LED illumination apparatus of claim 1, wherein the plurality of lenses is arranged in a plurality of columns.

3. The LED illumination apparatus of claim 2, wherein the number of lenses in at least one of the plurality of columns is different from the number of lenses in another one of the plurality of columns.

4. The LED illumination apparatus of claim 2, wherein the plurality of lenses is arranged in a form of a matrix.

5. The LED illumination apparatus of claim 2, wherein the plurality of LED chips arranged in each of the plurality of columns is electrically connected to one another in parallel.

6. The LED illumination apparatus of claim 1, wherein the light source unit includes a first substrate on which the plurality of LED chips is mounted and a second substrate on which a plurality of first substrates is mounted.

7. The LED illumination apparatus of claim 6, wherein the first substrate is mounted on the second substrate in a plurality of columns.

8. The LED illumination apparatus of claim 6, wherein the first substrate is mounted on the second substrate in a form of a matrix.

9. The LED illumination apparatus of claim 1, wherein the LED chip is covered by a fluorescent resin including fluorescent materials, and the fluorescence materials are excited by the light emitted from the LED chip to emit a light having a different wavelength from a wavelength of the light emitted from the LED chip.

10. The LED illumination apparatus of claim 1, wherein each of the emission surfaces is smaller than an area of the lens.

11. The LED illumination apparatus of claim 1, wherein the lens includes a Fresnel lens.

12. The LED illumination apparatus of claim 1, wherein the lens unit has a plurality of partition regions and each of the plurality of partition regions includes a Fresnel lens.

13. The LED illumination apparatus of claim 1, wherein the lenses are formed in the inner regions of the lens unit and the lenses are not formed the outer regions of the lens unit.

* * * * *